United States Patent [19]

Schwengeler

[11] 4,176,512

[45] Dec. 4, 1979

[54] ROTOR BRAKING APPARATUS AT EACH SPINNING UNIT OF AN OPEN-END SPINNING MACHINE

[75] Inventor: Peter Schwengeler, Winterthur, Switzerland

[73] Assignee: Rieter Machine Works Ltd., Winterthur, Switzerland

[21] Appl. No.: 919,043

[22] Filed: Jun. 26, 1978

Related U.S. Application Data

[63] Continuation of Ser. No. 823,874, Aug. 11, 1977, abandoned.

[30] Foreign Application Priority Data

Aug. 26, 1976 [CH] Switzerland ..... 10823/76

[51] Int. Cl.[2] ..... D01H 7/22

[52] U.S. Cl. ..... 57/88

[58] Field of Search ..... 57/58.89, 75, 88, 104, 57/105

[56] References Cited

U.S. PATENT DOCUMENTS

| | | | |
|---|---|---|---|
| 3,765,161 | 10/1973 | Kobler | 57/88 |
| 3,895,483 | 7/1975 | Grau | 57/58.89 X |
| 3,999,365 | 12/1976 | Suzuki | 57/88 |
| 4,058,966 | 11/1977 | Roasch | 57/78 |

*Primary Examiner*—John Petrakes

*Attorney, Agent, or Firm*—Werner W. Kleeman

[57] ABSTRACT

A rotor braking apparatus at each spinning unit of an open-end spinning machine, wherein at each spinning unit, for stopping the rotor, said rotor is arranged to be pivotable from an operating position away from a drive belt into an idle position, in which position there is pressed against the rotor shaft a brake lever provided with a brake shoe. An additional mechanism is provided which activates the rotor brake shoe without pivoting the rotor shaft from its operating position.

10 Claims, 4 Drawing Figures

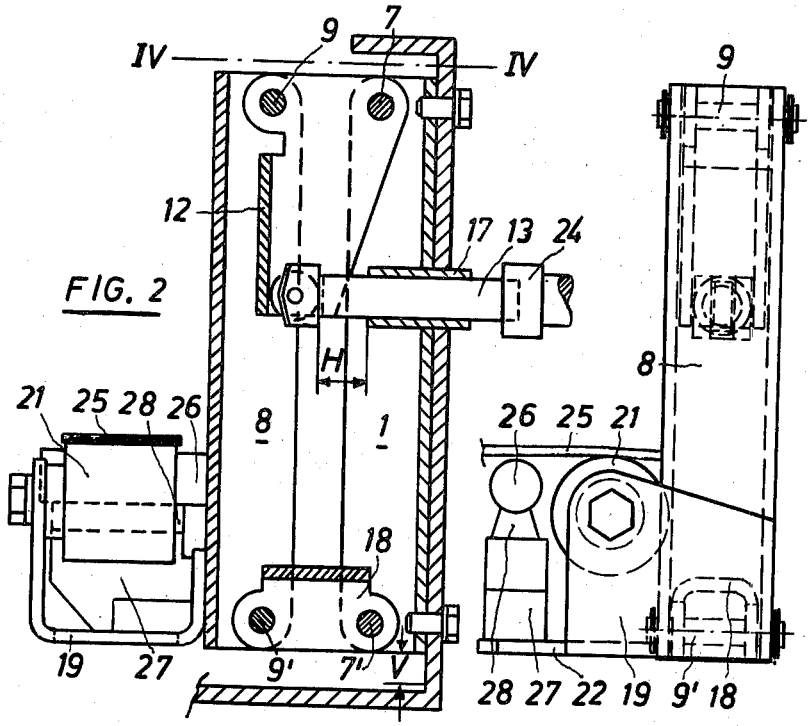
FIG. 2
FIG. 3
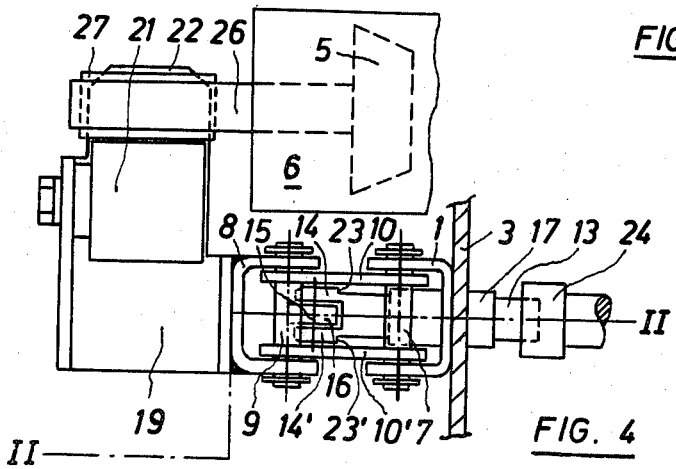
FIG. 4

ROTOR BRAKING APPARATUS AT EACH SPINNING UNIT OF AN OPEN-END SPINNING MACHINE

CROSS-REFERENCE TO RELATED CASE

This is a commonly assigned, copending continuation application of my U.S. application Ser. No. 823,874, filed Aug. 11, 1977 and entitled "Rotor Braking Apparatus At Each Spinning Unit Of An Open-End Spinning Machine", now abandoned.

BACKGROUND OF THE INVENTION

The present invention relates to a new and improved rotor braking apparatus at each spinning unit of an open-end spinning machine, at which spinning unit, for stopping the rotor, said rotor is arranged to be pivotable from an operating position away from a drive belt into an idle position.

In an operating open-end spinning machine the individual rotors at each spinning position are driven by a common tangential drive belt. For eliminating thread breakages and for cleaning purposes there is required the possibility of uncovering and stopping the rotor without necessitating interruption of the spinning process at the other spinning units.

In a known open-end spinning machine the rotor of an individual spinning unit is uncovered by pivoting away part of the spinning unit housing from the machine frame. During said pivoting motion there is also released the fixation of a rotor support housing, receiving the rotor and its drive shaft, on the spinning unit housing in such manner that the rotor support housing, under the influence of its own weight, effects a downward pivoting motion until a brake lever pivotably arranged at the lower side of the rotor support housing contacts a rail of the machine frame and is pressed-on by the weight of the housing. By virtue of this pivoting motion the drive shaft of the rotor is pivoted away from the tangential belt driving it from above and comes to contactingly rest on the brake shoe, the friction lining or coating of which brakes the drive shaft and stops the rotor.

According to another known open-end spinning machine the rotor also is uncovered by pivoting part of the spinning unit housing, but without moving the rotor and its support housing. In this machine the tangential drive belt at each spinning unit is guided over a contact or presser roll mounted on a rod and during the spinning operation is pressed by the contact or presser roll against the drive shaft of the rotor. For stopping the rotor the rod is shifted by activating a brake lever in such manner that the contact or presser roll with the tangential drive belt is lifted off the rotor drive shaft on the drive side and that the rotor drive shaft is stopped on the opposite side by a brake also mounted on the rod.

Furthermore, from German Pat. No. 2,109,975 there is taught to the art an open-end spinning machine in which a brake is activated as a part of the spinning unit housing is opened, without pivoting the rotor, which brake mechanism lifts the tangential drive belt off the rotor shaft and presses a brake lining against the rotor shaft. Using an additional brake lever the brake mechanism in this spinning machine also can be activated without opening the part of the spinning unit housing, in such manner that repiecing of broken thread ends should be rendered possible without cleaning the rotor and without opening the part of the spinning unit housing. This machine, however, is not feasible for automatic repiecing and starting the spinning process, since automatic operation of the large and cumbersome brake lever requires complicated mechanisms.

Upon cleaning of the rotor or upon elimination of an end or thread breakage, during which process the rotor of course is also cleaned, the spinning process is to be restarted. The manual restarting process requires great skill on the part of the operator as only the short time interval, during which the drive shaft of the rotor is again contacted by the tangential drive belt and is accelerated to the operational speed, is available for piecing-up the broken end. The technological process of piecing of the end is optimally effected in the rotor within fractions of a second, as required by the process, only within a very small range of rotational speeds. During manual piecing it thus is extremely difficult to catch this optimum range. At very high rotor speeds which are increasingly required, satisfactory manual piecing even can become unpracticable, so that only an automatic restarting of the spinning process can be considered.

Instead of providing each spinning unit with a complicated and expensive restarting device, a restarting device has been proposed which is supported on a rail on the open-end spinning machine and which can be moved along the machine.

For piecing-up, the device is moved to any desired spinning unit where the restarting of the spinning process is effected automatically. Since a device of this type can operate on all spinning positions of a machine, it is economically more feasible than an automatic restarting device provided at each spinning unit.

The restarting device controls all operations of the restarting of the spinning process and in part effects them itself according to a spinning restarting program which can be optimally adjusted in accordance with the characteristics of the yarn to be spun. Included in these functions are also the releasing of the brake and the acceleration of the drive shaft of the rotor at the right moment in time in such a manner that the rotor, during the piecing process, is driven at a speed within the appropriate range of rotational speeds at the time when the fibre ring in the rotor required for piecing has just been formed and at the time when the piecing yarn end has just been brought back into the rotor. In this manner the rotor is accelerated to the higher operational speed only after completion of the piecing action at a speed within the optimum range of rotational speeds.

In machines with pivotably arranged rotors automatic piecing using a travelling piecing device presents difficulties as the rotor cannot be stopped in its spinning operating position.

SUMMARY OF THE INVENTION

It thus is an important object of the present invention to permit automatic restarting of the spinning process by a travelling restarting device also on a machine of the type mentioned above, using means of simple design which also can be subsequently mounted.

Now in order to achieve this object, and others which will become more readily apparent as the description proceeds, there is provided a rotor braking apparatus at each spinning unit of an open-end spinning machine, at which spinning unit for stopping the rotor, the rotor is pivotable from a spinning operating position away from a drive belt into an idle position. In the idle position a brake lever with a brake shoe is pressed against the rotor shaft. An additional mechanism is provided which activates the rotor brake shoe in the operating position of the rotor without pivoting the rotor shaft. Further, there is provided as part of the additional mechanism a working member connected with a movable member which is movable connected with a rigid support member mounted on a machine frame and a device for urging said movable member into an operative position for effecting a disengagement of the drive connection for the rotor and engagement of the brake lever for initiating a brake action of the rotor.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 2 is the same view of the inventive apparatus as in FIG. 1, but in its working position, partially in section along the line II—II of FIG. 4;

FIG. 3 is a view of the inventive apparatus in its working position as seen along the spinning machine; and FIG. 4 is a top view of the inventive apparatus in its working position looking from line IV—IV of FIG. 2.

DETAILED DESCRIPTION OF THE PREFERRED EMBODIMENTS

Figure 1:
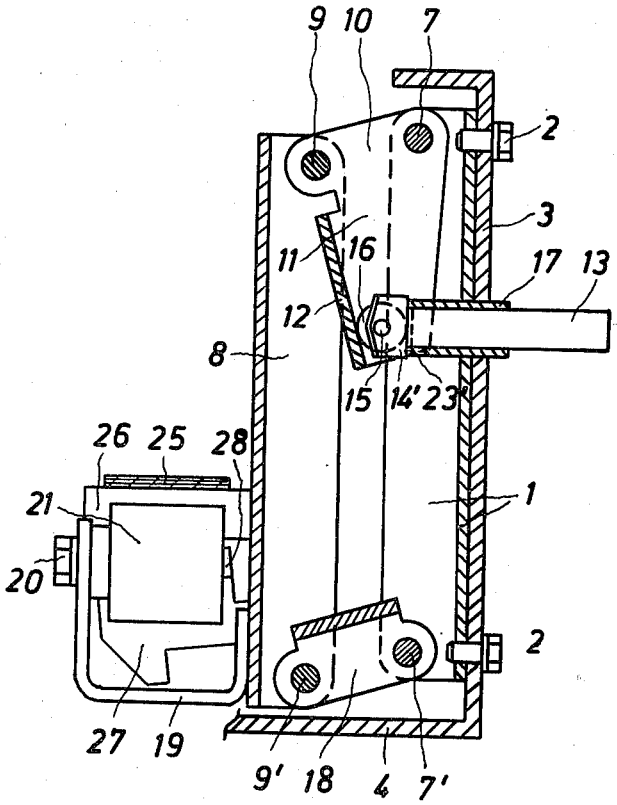
FIG. 1 is a front view, partially in section, as seen across the spinning machine, of a rotor drive arrangement, the inventive apparatus being shown in its idle position.

Describing now the drawings, a vertically arranged U-shaped rigid support member 1 (FIG. 2 and FIG. 4) of the additional mechanism is rigidly mounted onto a wall 3 of a machine frame 4 by screws 2 or equivalent structure (FIG. 1). The additional mechanism is thus mounted laterally of a rotor housing 6 surrounding a rotor 5 (FIG. 4). In the support member 1 there are supported two shafts or axles 7, 7'. In a likewise vertically extending U-shaped pivoting or movable member 8 there are also supported two axles or shafts 9, 9'. The two upper shafts 7 and 9 receive two legs 10, 10' of an intermediate member 11 forming a connecting wall 12 arranged at right angles with respect to the legs 10, 10'. The two lower shafts 7', 9' are connected by another U-shaped connecting member 18.

A plunger or bolt 13 (FIG. 4) supports a roll 16 which is rotatably arranged on a shaft 15 between two legs 14, 14'. The plunger 13 is slidably arranged in a tube 17 which is mounted in a not particularly referenced opening in the support member 1 and in the wall 3 of the machine frame 4.

On the U-shaped pivoting member 8 there is rigidly mounted a further approximately U-shaped working member or bracket 19. On the higher leg of this working member 19 there is mounted an idler roll 21 by means of a screw 20 or equivalent structure. The working member 19 is also provided at its base with a horizontal extension 22 (FIG. 3).

In the described arrangement the pivoting member 8 together with the shaft or axle 9 is pivotably mounted via the intermediate member 11 on the shaft 7 of the support member 1 rigidly mounted onto the machine frame 4. For precisely guiding the pivoting motion the members 1 and 8 also are interconnected at their lower ends via the U-shaped intermediate member 18. The fixed shafts 7, 7' together with the movable shafts 9, 9' thus form a precise parallelogram guide arrangement. The pivoting member 8 is pulled down under its own weight, the wall 12 of the intermediate member 11 thereby being pressed against the roll 16 of the plunger 13 in such a manner that the plunger 13 maintains the pivoting member 8 in its idling position as the surfaces 23, 23' of the plunger legs 14, 14' rest against the tube 17.

In order to pivot the pivoting member 8 from its idling position into its working position, in which working position the rotor 5 is braked, a pressure force must be exerted upon the plunger 13. This force is generated by a travelling restarting device, containing a pressure pin or bolt 24, which has arrived at the respective spinning position. As the pressure pin 24 is shifted through a horizontal distance H to the left side of FIG. 2, the plunger 13 is also shifted through a distance H and the pressure force is transmitted via the rotatable roll 16 onto the wall 12 which in turn is correspondingly pivoted to the left about the shaft 9. Due to this pivoting motion of the wall 12 the pivoting member 8 is lifted through a vertical distance V. In the embodiment under discussion, the distances H and V are coordinated in such a manner that the wall 12 of the intermediate member 11 in its braking or working position is positioned vertically and the pivoting member 8 is lifted through the same elevational position as the rigidly mounted support member 1.

During the normal spinning operation of the spinning unit, during which the pivoting member 8 is in its idle position, a tangential drive belt 25 (FIG. 1) drives the drive shaft 26 of the rotor 5. A brake lever 27 pivotably supported on the rotor housing 6 together with its brake shoe 28 is freely suspended in its idling position such that its end is located exactly below the drive shaft 26 without contacting the extension 22 of the working member 19 which is located therebelow. The idler roll 21, also in its idling position, is located below the tangential drive belt 25 laterally of the drive shaft 26.

During the transition of the additional braking apparatus from its idling position to its working position the plunger 13 is shifted through the horizontal distance H and thus the pivoting member 8 is lifted through the vertical distance V in such a manner that the working member 19 connected therewith together with its idler roll 21 and its extension 22 is also lifted through the vertical distance V. During this operation the idler roll 21 lifts the tangential drive belt 25 off the rotor shaft 26 (FIG. 3) so that now the tangential drive belt 25 drives the idler roll 21 instead of the drive shaft 26. The extension 22 lifts the brake lever 27 to such an extent that its braking shoe 28 is pressed against the drive shaft 26 which thus is immediately stopped.

If an end breakage occurs on a spinning position of an open-end spinning machine of this type or if the rotor 5 needs cleaning, the rotor is uncovered and stopped in the usual manner by pivoting out part of the spinning unit housing and is cleaned. Upon cleaning of the rotor the opened part of the spinning unit housing is pivoted back in such a manner that the rotor is again driven but the spinning process is not yet restarted. Now the restarting device is brought to the respective spinning unit, during which operation care is to be taken that the pressure pin or bolt 24 of the restarting device is exactly positioned upon the plunger 13 of the additional braking mechanism. The restarting of the spinning process is now effected according to the program stored in the restarting device. First the pressure pin 24 is shifted over the distance H in such a manner that the additional braking apparatus is brought into its braking position, such that the rotor 5 is again stopped. Upon completion of all operations required in the restarting process, the restarting device retracts the pressure pin or bolt 24 exactly at the preset moment in time in such a manner that the additional braking apparatus drops back to its idle position and the rotor 5 is again driven and accelerated to its operational speed. In this sequence the moment in time of interruption of the braking action is present so precisely that the piecing-up of the end in the spinning rotor 5 is effected while the rotor rotates at a speed within the optimum speed range for this operation. By mounting the described additional braking apparatus at each spinning position, the superior automatic restarting of the spinning process is also rendered applicable on an open-end spinning machine in which otherwise the rotor is pivoted for stopping the rotor.

While there are shown and described present preferred embodiments of the invention, it is to be distinctly understood that the invention is not limited thereto, but may be otherwise variously embodied and practiced within the scope of the following claims.

Accordingly, What I claim is:

1. In a rotor braking apparatus provided at each spinning unit of an open-end spinning machine, wherein each such rotor spinning unit is provided with a rotor which is movable from an operating position away from a drive belt into an idle position for stopping the rotor, in which idle position a shaft of the rotor is contacted by a brake lever having a brake shoe, the improvement which comprises:

an additional mechanism for activating the rotor brake shoe without moving the rotor shaft from its operating position;

said additional mechanism comprising:

a machine frame;

a rigid support member mounted on said machine frame;

a movable member movably connected with said rigid support member mounted on said machine frame;

a working member connected with said movable member; and a device for urging said movable member into an operative position for effecting disengagement of a drive connection for the rotor and engagement of the brake lever for initiating a braking action of the rotor.

2. In a rotor braking apparatus provided at each spinning unit of an open-end spinning machine, wherein each such rotor spinning unit is provided with a rotor which is movable from an operating position away from a drive belt into an idle position for stopping the rotor, in which idle position a shaft of the rotor is contacted by a brake lever having a brake shoe, the improvement which comprises:

an additional mechanism for activating the rotor brake shoe without moving the rotor shaft from its operating position;

said additional mechanism comprising:

a machine frame;

a rigid support member mounted on said machine frame;

a movable member movably connected with said rigid support member mounted on said machine frame;

a working member connected with said movable member;

a device for urging said movable member into an operative position for effecting disengagement of a drive connection for the rotor and engagement of the brake lever for initiating a braking action of the rotor;

said working member being provided with an extension;

a rotatably supported idler roll carried by said extension;

said movable member and said rigid support member each having at least one shaft;

said movable member being pivotable about said rigid support member;

said machine frame having a wall;

an intermediate member for mounting said movable member on said wall of said machine frame;

said intermediate member including a plate which is pivotably mounted on said shaft of the movable member and said shaft of the rigid support member;

a plunger slidably mounted at said rigid support member and said wall of the machine frame;

said device for urging said movable member into an operative position includes a restarting device for exerting a pressure force onto said plate of the intermediate member by means of the plunger slidably mounted at said rigid support member and said wall of the machine frame, said pressure force effecting the pivotable movement of the movable member.

3. The improvement as defined in claim 2, wherein:

said plunger is mounted for horizontal sliding movement and coacts with the movable member so as to vertically lift and lower said movable member such that upon lifting of the movable member the brake lever together with the brake shoe is actuatable by the extension of the working member.

4. The improvement as defined in claim 3, wherein:

said plunger during horizontal displacement thereof lifts said movable member from an idle position into a working position.

5. The improvement as defined in claim 3, wherein:

said movable member is maintained in an idle position during which time no pressure force is exerted upon the slidable plunger;

said extension and said idler roll being arranged on the working member in such a manner that in a working position of said working member said idler roll lifts the drive belt off the rotor shaft and said extension presses the brake shoe of the brake lever against the rotor shaft.

6. The improvement as defined in claim 2, wherein:

each said movable member and said rigid support member being provided with a second shaft;

a further intermediate member supported on said second shafts for interconnecting the movable member and said rigid support member.

7. The improvement as defined in claim 6, wherein:

said two intermediate members and said four shafts define a parallelogram guide arrangement for said movable member.

8. The improvement as defined in claim 2, wherein:

said slidable plunger has an end provided with two legs; and a roll for transmitting the pressure force rotatably mounted between said two legs.

9. The improvement as defined in claim 2, wherein:

said movable member is maintained in an idle position during which time no pressure force is exerted upon the slidable plunger.

10. In a rotor braking apparatus provided at each spinning unit of an open-end spinning machine, wherein each such rotor spinning unit is provided with a rotor which is pivotable from an operating position away from a drive belt into an idle position for stopping the rotor, in which idle position a shaft of the rotor is contacted by a brake lever having a brake shoe, the improvement which comprises:

an additional mechanism for activating the rotor brake shoe without pivoting the rotor shaft from its operating position;

said additional mechanism comprising:

a working member provided with an extension;

a rotatably supported idler roll carried by said working member;

a pivoting member having at least one shaft and connected with said working member;

a rigid support member having at least one shaft;

a machine frame having a wall;

an intermediate member including a plate and pivotably mounted on said one shaft of the pivoting member and said one shaft of the rigid support member;

said pivoting member being mounted on the machine frame via the intermediate member;

said pivoting member being pivotable about said rigid support member;

a restarting device for exerting a pressure force onto said plate of the intermediate member;

a plunger slidably mounted at said rigid support member and said wall of the machine frame for transmitting said pressure force exerted by said restarting device onto said plate of the intermediate member, said pressure force effecting the pivotal movement of the pivoting member.

* * * * *